US005079836A

United States Patent [19]

Swars

[11] Patent Number: 5,079,836

[45] Date of Patent: Jan. 14, 1992

[54] PROCESS AND APPARATUS FOR PRODUCING CONNECTIONS BETWEEN CRANKSHAFT PARTS

[75] Inventor: Helmut Swars, Bergisch Gladbach, Fed. Rep. of Germany

[73] Assignee: Emitec Gesellschaft für Emissionstechnologie mbH, Lohmar, Fed. Rep. of Germany

[21] Appl. No.: 452,568

[22] Filed: Dec. 18, 1989

[30] Foreign Application Priority Data

Dec. 17, 1988 [DE] Fed. Rep. of Germany ..... 3842591

[51] Int. Cl.[5] ..... B21K 1/08

[52] U.S. Cl. ..... 29/888.08; 29/888.1; 29/6.01; 29/523; 29/505; 403/31; 285/100

[58] Field of Search ..... 72/61, 62; 285/31, 100, 285/331; 403/31; 29/6.01, 421.1, 523; 29/505, 888.08, 888.1

[56] References Cited

U.S. PATENT DOCUMENTS 2,770,874 10/1956 Lindow ..... 29/421.1
4,388,752 6/1983 Vinciguerra et al. ..... 29/421.1
4,750,250 6/1988 Maus et al. ..... 29/523
4,761,870 8/1988 Urano ..... 29/421.1

FOREIGN PATENT DOCUMENTS 2107460 8/1972 Fed. Rep. of Germany ..... 72/62

*Primary Examiner*—P. W. Echols
*Assistant Examiner*—David P. Bryant
*Attorney, Agent, or Firm*—Toren, McGeady & Associates

[57] ABSTRACT

A process and an assembly for producing force-locking connections between tubular members inserted one into the other or for attaching elements slid onto tubular members, by permanent radial expansion of several sleeves slid into the tubular members in a coaxial arrangement. The sleeves are filled with a pressurized fluid and pistons are inserted into end apertures of the sleeves. The apertures of adjoining sleeves which face each other are closed by a single piston. Finally, by bringing the pistons closing the outwardly facing apertures of the outer sleeves closer together, the internal pressure is increased.

5 Claims, 1 Drawing Sheet

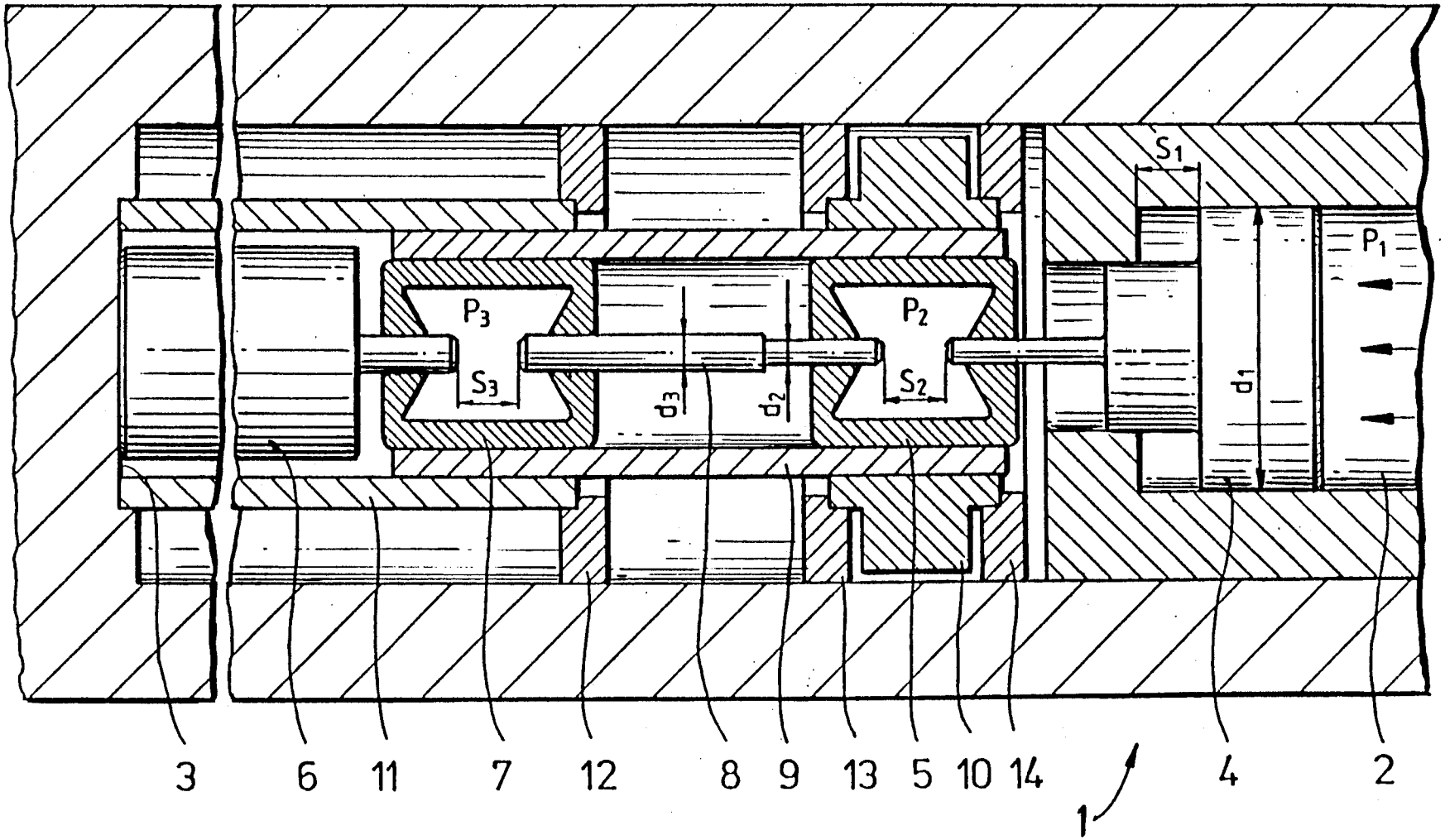
P1
d1
S1
P2
S2
d2
d3
P3
S3
1
2
3
4
5
6
7
8
9
10
11
12
13
14

PROCESS AND APPARATUS FOR PRODUCING CONNECTIONS BETWEEN CRANKSHAFT PARTS

BACKGROUND OF THE INVENTION

The invention relates to a process for producing force-locking connections between tubular members which are inserted one into the other or for attaching elements slid onto tubular members, by permanent radial expansion of several sleeves slid into these in a coaxial arrangement.

Such a process has been used for producing assembled shafts such as crankshafts and transmission shafts. One problem with such a process is caused by the application of pressure to the sleeves which are to be subjected to permanent radial expansion. So far, pressure agent probes have been used which are connected to pressure generating devices, which rest against the sleeves with seals arranged in pairs and through whose inner channels a pressure agent is applied to the sealed sleeves. The disadvantages of this method are the expensive design of the probes and the limited service life of the seals.

SUMMARY OF THE INVENTION

Accordingly, it is an object of the present invention to provide an improved process and device in the case of which the generation of pressure is simplified, where the problem of seal wear is eliminated and where there is a possibility of building up a graduated pressure in the different sleeves.

Pursuant to this object, and others which will become apparent hereafter, one aspect of the present invention resides in filling the sleeves with a pressure medium and inserting pistons into the apertures of the sleeves. The apertures of adjoining sleeves facing each other are closed by one single piston. By bringing the two pistons closing the outwardly facing apertures of the outer sleeves closer together, the internal pressure of the pressure medium in the sleeves is increased.

With such a process, the pressure build-up takes place in the sleeves themselves, so that there is no longer any need for pressure-proof connecting lines leading from a remote pressure generator to the sleeves. The previously used probes are replaced by simple turned parts without any bores, so that the assembly in accordance with the invention required for carrying out the process has an extremely simple design. Sealing of the pistons relative to the sleeves may be effected on a very small diameter so that, again, there is no need for expensive flexible seals. The seals of simple shape need to act only once and can possibly be a sealing substance.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE shows an assembly produced in accordance with the present invention.

DETAILED DESCRIPTION OF THE PREFERRED EMBODIMENT

The FIGURE shows a holding device 1 where, in a cylinder 2 (not illustrated in great detail) a pressure $P_1$ is applied, with the opposite end of the holding device 1 being provided with a stop 3. Inside the cylinder 2, there is guided a piston 4 which, with a greatly reduced, graduated diameter engages a first sleeve 5. The stop 3 supports a further piston 6 which, also with a greatly reduced diameter, engages a second sleeve 7. A further central graduated piston 8 engages from the opposite end the two sleeves 5 and 7.

The sleeves are inserted into a first tube 9, and an element 10 is slid on the first tube 9 in the region of the first sleeve 5 and a further tubular member 11 is slid on the first tube 9 in the region of the second sleeve 7. The tubular member 11, the first tube 9 and the element 10 are fixed and held in centering means 12, 13, 14 connected to the device 1.

When the pressure $P_1$ is applied, pressure $P_2$ builds up in the sleeve 5 and pressure $P_3$ builds up in sleeve 7, with the pistons 4 and 8 moving to the left, whereas the piston 6 is supported on stop 3. The relationship of pressures $P_2$ and $P_3$ is determined by the relationship of diameters $d_2$ and $d_3$ of the free piston 8.

While the invention has been illustrated and described as embodied in a process for producing connections, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

I claim:

1. A process for producing force-locking connections between tubular members inserted one into the other, by permanent radial expansion of a plurality of sleeves slid into said tubular members in a coaxial arrangement, the process comprising:

providing a plurality of tubular members;

providing a plurality of radially expandable sleeves having axially aligned apertures;

axially aligning said tubular members such that end portions thereof are in overlapping, juxtaposed relation;

filling said sleeves with a fluid;

aligning said sleeves such that said apertures are in axial alignment;

inserting pistons into the apertures in the sleeves such that the axially aligned apertures of adjacent sleeves are closed by a single piston;

inserting the assembly of said pistons and said sleeves into said axially aligned tubular members such that each of said sleeves is in radial alignment with a corresponding juxtaposed portion of said tubular members;

inserting a piston into each of the outwardly facing apertures of the two outermost sleeves of the assembly; and bringing the two pistons which close the outwardly facing apertures of the two outermost sleeves closer together such that internal pressure in the sleeves is increased to radially expand said sleeves, and thereby radially expand said tubular members to produce a force-locking connection between the tubular members.

2. An assembly for producing force-locking connections between tubular members and element slid onto said tubular members, by permanent radial expansion of several adjoining sleeves slid into said tubular members in a coaxial arrangement, the assembly comprising:

a plurality of adjoining radially expandable sleeves slid into the tubular members so as to be coaxially arranged, the sleeves having axially aligned apertures with a freely movable piston located between and inserted into the apertures of adjacent sleeves;

a device for holding said tubular members and the elements to be attached thereto;

a piston arranged so as to close an outer aperture of a sequentially first one of the adjoining sleeves;

a fixed stop for the piston closing the outer aperture of the first sleeve;

a pressure generating working piston arranged so as to close an outer aperture of a sequentially last one of the adjoining sleeves.

3. The assembly to claim 2, wherein each of the pistons has a different diameter for generating different pressure levels within the sleeves.

4. The assembly of claim 3, wherein the diameter of at least some of the pistons is graduated between the sleeves.

5. A process for producing force-locking connections between a tubular member and a plurality of lobe members slid onto said tubular member, by permanent radial expansion of a plurality of sleeves slid into said tubular member in a coaxial arrangement, the process comprising:

providing a tubular member;

providing a plurality of lobe members, each said lobe member having an annular hole through its longitudinal axis;

providing a plurality of radially expandable sleeves having axially aligned apertures;

sliding said lobe members onto said tubular member such that said lobe members and said tubular member are in coaxial arrangement;

filling said sleeves with a fluid;

aligning said sleeves such that said apertures are in axial alignment;

inserting pistons into the apertures in the sleeves such that the axially aligned apertures of adjacent sleeves are closed by a single piston;

inserting the assembly of said pistons and said sleeves into said tubular member such that each of said sleeves is in radial alignment with a corresponding juxtaposed lobe member;

inserting a piston into each of the outwardly facing apertures of the two outermost sleeves of the assembly; and bringing the two pistons which close the outwardly facing apertures of the two outermost sleeves closer together such that internal pressure in the sleeves is increased to radially expand said sleeves, and thereby radially expand said tubular member to produce a force-locking connection between the tubular member and the lobe members.

* * * * *